US005435163A

United States Patent [19]

Schäfer

[11] Patent Number: 5,435,163

[45] Date of Patent: Jul. 25, 1995

[54] APPARATUS FOR HYDRAULICALLY SHAPING A HOLLOW BODY

[75] Inventor: August W. Schäfer, Drolshagen, Germany

[73] Assignee: Wilhelm Schafer Maschinenbau GmbH & Co., Wilnsdorf, Germany

[21] Appl. No.: 255,778

[22] Filed: Jun. 8, 1994

[30] Foreign Application Priority Data

Jun. 18, 1993 [DE] Germany ..... 43 20 236.5

[51] Int. Cl.[6] ..... B21D 22/10

[52] U.S. Cl. ..... 72/58; 72/62; 29/421.1

[58] Field of Search ..... 72/58, 62, 61; 29/421.1

[56] References Cited

U.S. PATENT DOCUMENTS

| | | | |
|---|---|---|---|
| 2,203,868 | 6/1940 | Gray et al. | 72/62 |
| 3,350,905 | 11/1967 | Ogura | 72/28 |
| 4,317,348 | 3/1982 | Halene et al. | 72/62 |

FOREIGN PATENT DOCUMENTS

| | | | |
|---|---|---|---|
| 512160 | 11/1992 | European Pat. Off. . | |
| 2679159 | 1/1993 | France . | |
| 0082229 | 5/1985 | Japan | 72/58 |

OTHER PUBLICATIONS

Industrie-Anzeiger, Werkzeugmaschine und Fertigungstechnik, Teil II Umformtechnik, 10 Mai 1966, pp. 107-110, pp. 137-140.

*Primary Examiner*—David Jones

*Attorney, Agent, or Firm*—Herbert Dubno; Andrew Wilford

[57] ABSTRACT

An apparatus for hydraulically shaping a hollow body has a stationary base, a die fixed on the base and formed with a cavity having an inner surface and axially oppositely open ends so that a tubular workpiece can be held in the cavity with ends of the workpiece exposed at the ends of the cavity, and a pair of pistons fittable with the workpiece ends. Respective actuators can displace the pistons toward each other and against the ends of the workpiece in the cavity. A hydraulic liquid is fed at high pressure through one of the pistons to an interior of the workpiece in the cavity to deform the workpiece. Respective first guides support the pistons on the base for vertical movement thereon, respective second guides support the pistons on the base for horizontal movement thereon, and respective third guides support the pistons on the base for pivotal movement about respective centers.

8 Claims, 2 Drawing Sheets

APPARATUS FOR HYDRAULICALLY SHAPING A HOLLOW BODY

FIELD OF THE INVENTION

The present invention relates to an apparatus for hydraulically shaping a hollow body. More particularly this invention concerns such a method used to make hollow metal parts.

BACKGROUND OF THE INVENTION

It is known (see for example *Industrie-Anzeiger* No. V, 10 May 1966) to form a hollow metal part by confining a piece of metal tubing in a die having an inner surface corresponding to the outer surface of the part to be produced, with the ends of the tube exposed. Respective rams are pressed against the tube ends and hydraulic fluid at very great pressure, in excess of 1000 kp/mm$^2$, is fed in through one of the rams to the interior of the tube. The combined axial compression and internal pressurization cause the tube to expand radially to fill the die cavity, producing an accurately dimensioned cold-machined part.

Changeover from one product to another with such a manufacturing method is quite onerous. Clearly the die must be changed. In addition it is standard practice to change the pistons and rams also. This necessitates undoing complex hydraulic hookups and entails substantial down time.

OBJECTS OF THE INVENTION

It is therefore an object of the present invention to provide an improved apparatus for hydraulically shaping a hollow body.

Another object is the provision of such an improved apparatus for hydraulically shaping a hollow body which overcomes the above-given disadvantages, that is which can be easily adapted to different workpieces and products.

SUMMARY OF THE INVENTION

An apparatus for hydraulically shaping a hollow body has according to the invention a stationary base, a die fixed on the base and formed with a cavity having an inner surface and axially oppositely open ends so that a tubular workpiece can be held in the cavity with ends of the workpiece exposed at the ends of the cavity, and a pair of pistons fittable with the workpiece ends. Respective actuators can displace the pistons toward each other and against the ends of the workpiece in the cavity. A hydraulic liquid is fed at high pressure through one of the pistons to an interior of the workpiece in the cavity to deform the workpiece. According to the invention respective first guides support the pistons on the base for vertical movement thereon, respective second guides support the pistons on the base for horizontal movement thereon, and respective third guides support the pistons on the base for pivotal movement about respective centers.

Thus when production must be switched from one type of workpiece to another, all that needs to be changed is the die. Once the new die is bolted to the base, the pistons are repositioned to align with the workpiece ends, and production can restart. There is no need to undo high-pressure hydraulic lines.

According to the invention the first guides each include at least one upright post supported on the base and forming a vertical track in which the respective actuator and piston can move. More particularly, the first guides each include a pair of such posts flanking the respective actuator and piston and formed with grooves constituting the respective vertical track.

The second guides according to the invention include an annular track on the base. The posts are displaceable along the track. This track is a groove formed in the base.

The third guides each include an inner annular element on the respective piston and actuator having an outwardly concave outer surface centered on the respective center, and an outer annular element on the posts having an inwardly concave outer surface complementarily engaging the respective outer surface. The inner element is rockable about the respective center in the respective outer element.

The pistons and actuators in accordance with the invention are movable independently of each other. In addition more than two such piston/actuator units may be provided with the three guides when necessary.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
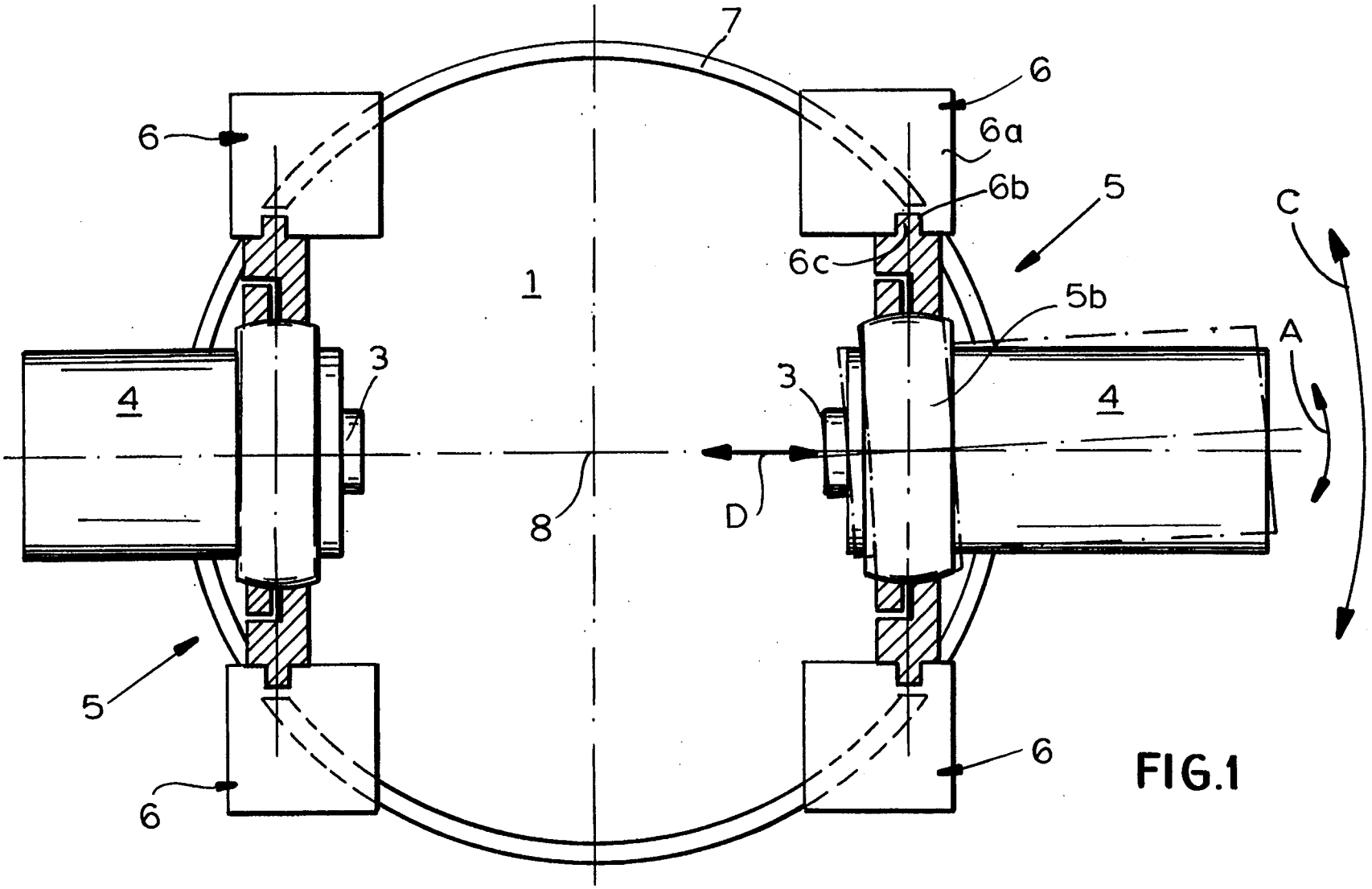
FIG. 1 is a top view of the apparatus of this invention.
Figure 2:
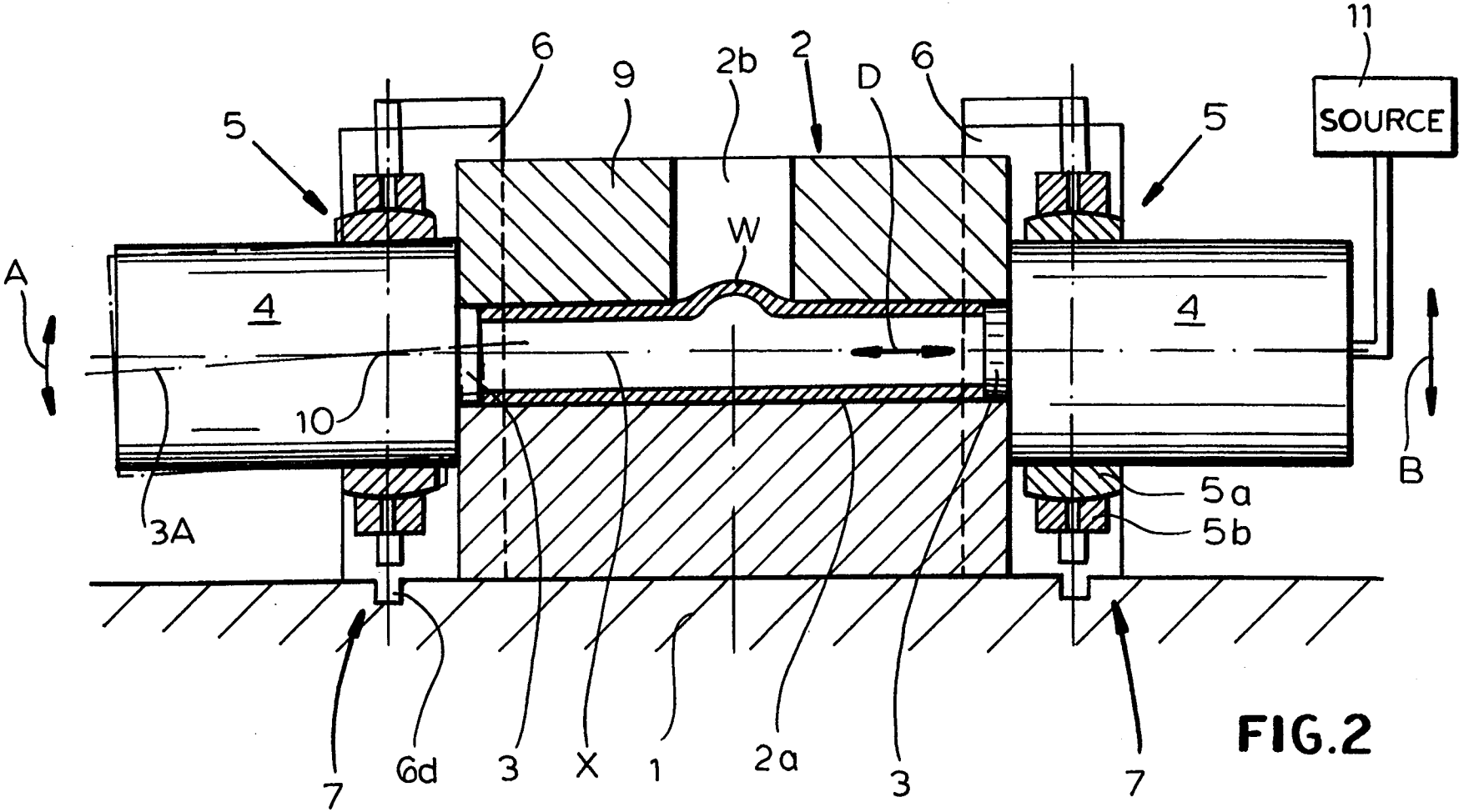
FIG. 2 is a partly diagrammatic and vertical sectional side view of the apparatus.

As seen in FIGS. 1 and 2 a standard two-part die 2 having a main cavity 2*a* extending along a horizontal axis X and a lateral branch 2*b* transverse to the axis X is supported on a base 1 between a pair of pistons or rams 3 carried on respective hydraulic actuators 4 for movement along respective axes 3A. A tubular workpiece W is normally fitted in the die cavity 2*a* and its ends are engaged by the pistons 3 which bear axially against it as indicated by arrow D. A source 11 of hydraulic fluid under enormous pressure is connected to one of the rams 3 and feeds liquid therethrough to the interior of the workpiece W to belly it out at the passage 2*b* to form a tee. Of course other shapes could be employed and there could be several such branches 2*b*. This is all relatively standard and is used to make hollow parts, for instance pipe fittings, bicycle parts, and housings.

According to the invention each piston 3 or its cylinder 4 is held in a ball mount 5 permitting it to pivot as indicated by arrow A about a point 10 lying on the respective axis 3A. Each ball mount 5 comprises an outwardly convex ring 5*a* carried on the cylinder 4 and an complementary inwardly concave ring 5*b*. The centers of curvature of the outer surface of the ring 5*a* and the inner surface of the ring 5*b* lie on the respective point 10.

The rings 5*b* are each vertically slidable with the respective pistons 3 as indicated by arrow B in a pair of vertical guides 6 each constituted as an upright post 6*a* formed with a vertical groove 6*b* in which fits a tongue 6*c* formed on the ring 5*b*. These guides 6 therefore provide a second degree of motion for the pistons 3, here vertical.

The base 1 is formed with a horizontal guide 7 constituted as a circularly annular and upwardly open groove centered on an upright axis 8 perpendicular to the axis X. The posts 6 have as seen in FIG. 2 downwardly extending part-circular ridges 6*d* that engage in the horizontal guide groove 7 so that the pistons 3 can move horizontally arcuately as indicated by arrow C. This gives the pistons 3 a third degree of motion, here horizon tal.

Thus when the die 2 is changed one can reposition the two rams 3 for the new die and get right back to work. Only the die 2 need be switched; the remaining elements of the forming equipment remain the same.

I claim:

1. An apparatus for hydraulically shaping a hollow body, the apparatus comprising:

a stationary base;

a die fixed on the base and formed with a cavity having an inner surface and axially oppositely open ends, whereby a tubular workpiece can be held in the cavity with ends of the workpiece exposed at the ends of the cavity;

a pair of pistons fittable with the workpiece ends;

respective actuators for displacing the pistons toward each other and against the ends of the workpiece in the cavity;

means for feeding a hydraulic liquid at high pressure through one of the pistons to an interior of the workpiece in the cavity and thereby deforming the workpiece;

respective first guides supporting the pistons on the base for vertical movement thereon;

respective second guides supporting the pistons on the base for horizontal movement thereon; and respective third guides supporting the pistons on the base for pivotal movement about respective centers.

2. The hydraulic-shaping apparatus defined in claim 1 wherein the first guides each include at least one upright post supported on the base and forming a vertical track in which the respective actuator and piston can move.

3. The hydraulic-shaping apparatus defined in claim 2 wherein the first guides each include a pair of such posts flanking the respective actuator and piston and formed with grooves constituting the respective vertical track.

4. The hydraulic-shaping apparatus defined in claim 2 wherein the second guides include an annular track on the base, the posts being displaceable along the track.

5. The hydraulic-shaping apparatus defined in claim 4 wherein the track is a groove formed in the base.

6. The hydraulic-shaping apparatus defined in claim 2 wherein the third guides each include an inner annular element on the respective piston and actuator having an outwardly concave outer surface centered on the respective center, and an outer annular element on the posts having an inwardly concave outer surface complementarily engaging the respective outer surface, the inner element being rockable about the respective center in the respective outer element.

7. The hydraulic-shaping apparatus defined in claim 1 wherein the pistons and actuators are movable independently of each other.

8. An apparatus for hydraulically shaping a hollow body, the apparatus comprising:

a stationary base;

a die fixed on the base and formed with a cavity having an inner surface and axially oppositely open ends, whereby a tubular workpiece can be held in the cavity with ends of the workpiece exposed at the ends of the cavity;

a pair of pistons fittable with the workpiece ends;

respective actuators for displacing the pistons toward each other and against the ends of the workpiece in the cavity;

means for feeding a hydraulic liquid at high pressure through one of the pistons to an interior of the workpiece in the cavity and thereby deforming the workpiece;

respective first guides supporting the pistons on the base for vertical movement thereon and each including at least one upright post supported on the base and forming a vertical track in which the respective actuator and piston can move;

respective second guides supporting the pistons on the base for horizontal movement thereon and including an annular track on the base, the posts being displaceable along the track; and respective third guides supporting the pistons on the base for pivotal movement about respective centers and each including an inner annular element on the respective piston and actuator having an outwardly concave outer surface centered on the respective center, and an outer annular element on the posts having an inwardly concave outer surface complementarily engaging the respective outer surface, the inner element being rockable about the respective center in the respective outer element.

* * * * *